United States Patent [19]

Bissonnette

[11] Patent Number: 4,515,218

[45] Date of Patent: May 7, 1985

[54] CASING STRUCTURES HAVING CORE MEMBERS UNDER RADIAL COMPRESSIVE FORCE

[75] Inventor: Harold S. Bissonnette, Broken Arrow, Okla.

[73] Assignee: The Dow Chemical Company, Midland, Mich.

[21] Appl. No.: 584,194

[22] Filed: Feb. 27, 1984

[51] Int. Cl.[3] ..... E21B 33/13

[52] U.S. Cl. ..... 166/328; 166/242

[58] Field of Search ..... 166/242, 327, 328

[56] References Cited

U.S. PATENT DOCUMENTS 3,162,246 12/1964 Wright ..... 166/328
3,481,397 12/1969 Baker ..... 166/327
4,442,894 4/1984 Callihan et al. ..... 166/328

FOREIGN PATENT DOCUMENTS 609059 11/1960 Canada ..... 166/328

*Primary Examiner*—Stephen J. Novosad
*Assistant Examiner*—William P. Neuder
*Attorney, Agent, or Firm*—V. Dean Clausen

[57] ABSTRACT

Casing hardware, such as float collars and shoes, are used in oil well cementing operations. Some of the collars and shoes are constructed of a steel casing with a concrete core inside the casing. The casing structure of the collars and shoes now available places the core under a predominantly shearing force, so that it will fail at relatively low downhole differential pressures. The present invention provides a new design for the casing structure, which places the concrete core under a predominantly compressive force, and greatly increases the amount of pressure the core can withstand without failing.

7 Claims, 3 Drawing Figures

CASING STRUCTURES HAVING CORE MEMBERS UNDER RADIAL COMPRESSIVE FORCE

BACKGROUND OF THE INVENTION

This invention relates generally to casing hardware of the type used in cementing of oil or gas wells. More particularly, the invention covers casing structures, such as float collars and shoes, which have a concrete core therein. The design of this casing structure places the concrete core under a predominantly compressive force.

The preparation of an oil well borehole for recovery of oil or gas involves a step referred to as primary cementing. In a typical primary cementing operation, a cement-water slurry is pumped down the well borehole through steel casing to critical points located in the annulus around the casing. There are several reasons for cementing an oil well. For example, cementing prevents flow of connate water into possible productive zones behind the casing, and it protects the casing against corrosion from subsurface mineral waters. Cementing also minimizes the hazard of polluting, with oil and salt water, supplies of fresh drinking water and recreational water contained in rock strata adjacent to the well. Other reasons for cementing the well are to prevent blow-outs and fires caused by high pressure gas zones behind the casing, and to prevent the casing from collapsing as a result of high external pressures which can build up underground.

In some cementing operations, the casing hardware includes pieces referred to as float collars and float shoes. The float collar is attached near the end of the casing and below that is another piece of casing known as a shoe joint, which couples the collar to the float shoe. In both the float collar and the shoe is a check valve, which is held in place by a core, which consists of a solid, drillable material. As the casing is lowered into the borehole, prior to injection of cement into the casing, the check valves are in a "closed" position. This prevents the casing from filling with drilling mud and other fluids in the hole. The word "float" implies that the casing will not fill with fluids, unless it is filled from the surface, so that these structures have enough buoyancy to float, or partially float, in the fluid and thus reduce the weight of the casing considerably.

During displacement of the cement slurry into the borehole annulus, the check valves are in an "open" positon. Once the desired amount of cement has been pumped into the annulus, the pumping is stopped, and the valves move back to a closed position. At this point in the operation, the level of cement in the annulus is somewhere above the check valves. Since the cement is much heavier than the displacement fluid, the cement column is in an "unbalanced" condition, and the closed valves retain the cement in this condition until it sets up. The solid concrete core and the check valves inside the float collar and shoe are then drilled out to prepare the well for the next step in the recovery operation.

The float collars and shoes in use today, as well as differential fill, orifice, and guide equipment, have a casing structure with a solid, drillable core material inside the casing. The purpose of the core material is to support a valve, or to provide a solid, drillable material for various other functions. In the present casing hardware, particularly float collars and shoes, the usual core materials are concrete, aluminum, or phenolic resin compositions. The casing structures equipped with concrete cores have a structural weakness which makes them unsatisfactory for general downhole use. An example of such equipment is the conventional float collar illustrated in FIG. 1.

As shown in FIG. 1, the inside surface of the casing structure 10 of the float collar resembles a corrugated surface, that is, it has alternating ridges 11 and grooves 12. The purpose of the corrugated surface is to provide a means for anchoring the concrete core 13 to the casing. When the concrete core 13 hardens inside the casing structure 10, the casing exerts a force against the core in a direction which is normal to the sloping sides 14 of the ridges 11. The force which is applied to the concrete core, as indicated by the broken line arrows 15, is predominantly a shearing force.

As the float is lowered into the borehole, the ball 16 in the check valve settles into a seat at the top of the ball cage 17, so that the valve is then in its closed position. When the check valve is in closed position, there is a substantial amount of upward pressure against the ball and the top of the ball cage and against the bottom face of the concrete core. This pressure is exerted by the drilling mud and other fluids in the borehole while the casing is being floated into place. Additional pressure is also exerted against the concrete core and the ball and cage top after the valve closes to retain the cement column in its unbalanced condition, as described earlier. Fluids above the concrete core also exert a substantial amount of downward pressure against the top face of the core. In actual practice, the pressure differential from above the core is usually greater than from below.

The ability of the concrete core to resist these pressure forces is entirely dependent on its shear strength. When the pressure forces exceed the shear strength of the core 13, the core usually fractures along the "shear" lines 18. The usual result is that the top section of the core (above the fracture line) along with the ball 16, and the top of the ball cage, separates from the bottom section of the core (below the fracture line), and allows fluid to by-pass the check valve.

From past studies, it is known that cement and cement aggregates are much stronger when placed in conditions of compression than in conditions of shear. This principle is utilized in the present invention to provide a new design for casing structures which improve the ability of the concrete core to withstand pressures which substantially exceed the pressure limits of the casing structure cores now in use.

SUMMARY OF THE INVENTION

The casing structure of this invention is designed for lowering into a borehole filled with fluids and slurry compositions. The longitudinal axis of the casing structure is defined by an imaginary straight line which extends through the center of the casing structure. The inner wall surface is defined by several primary sections, each of which has a long side and a short side. The short side of each primary section is joined to the long side of an adjacent primary section. The long side slopes away from the longitudinal axis of the casing structure, to define an outward slope angle. The inner wall surface is further defined by at least one secondary section. Each secondary section has two long sides; one of the long sides slopes away from the longitudinal axis of the casing structure, to define an outward slope angle, and the other long side slopes toward the longitudinal axis, so that it defines an inward slope angle.

The casing structure is filled with a solid material, such as concrete, and this structure is referred to as a core member. The core member has a lengthwise bore through it, which allows fluids or slurries to pass through the casing structure. Upper and lower faces are defined at opposite ends of the core member. The outer surface of the core member is in continuous contact with the inner wall surface of the casing structure, which provides means for retaining the core member within the casing structure. A closure member, such as a valve, is installed in the bore of the core section; and it has open and closed positions for controlling the flow of fluids or slurry compositions through the casing structure. In operation, the casing structure is lowered into a borehole filled with fluids and slurry compositions, causing the valve to move to its closed position. The fluids and slurry compositions exert a hydraulic force against both faces of the core member and against the closed valve. At the same time, the outward and inward slope angles along the inner wall surface of the casing structure cause the core member to be placed primarily under a radial compressive force. Under a compressive force, as opposed to a plain shearing force, the core member has a much greater resistance to the stress placed on it by the hydraulic forces.

DESCRIPTION OF THE INVENTION

Figure 2:
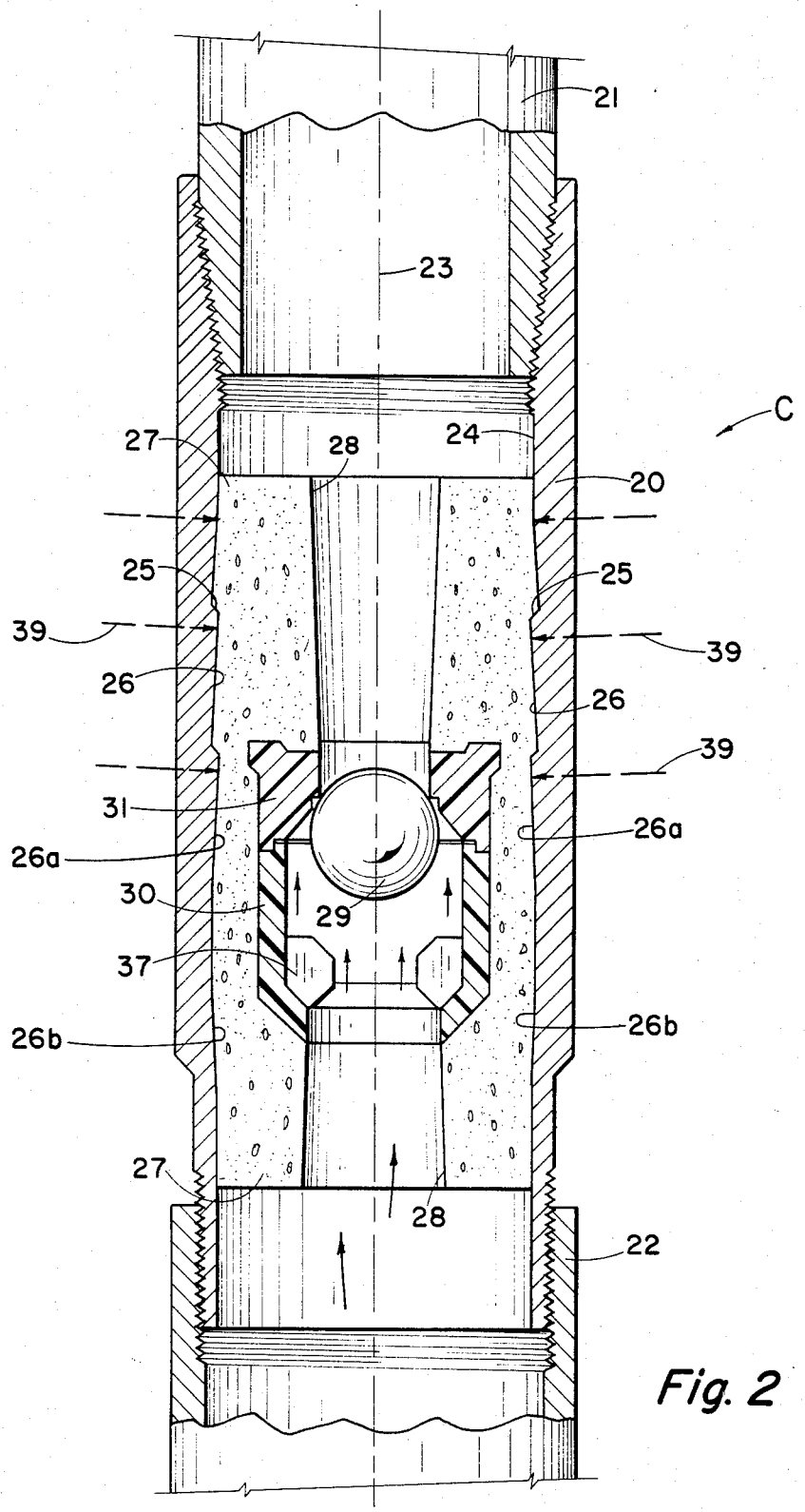
FIG. 2 is a front elevation view, mostly in section, of a float collar of the present invention. This float collar has the same type of concrete core and check valve as the collar illustrated in FIG. 1, but the casing structure is designed such that it places the core member under a compressive force.

A float collar, generally indicated by the letter C, is illustrated in FIG. 2 of the drawings. The casing structure 20 of the float collar is designed according to the practice of this invention. The upper end of the casing structure 20 is connected onto the end of a section of well casing 21. The lower end of the casing structure 20 is connected to the upper end of a length of casing 22, referred to as a shoe joint. A float shoe (not shown in FIG. 2) is connected to the lower end of the shoe joint.

The longitudinal axis of the casing structure 20 is defined by a straight line 23, which extends through the center of the casing structure (shown as a center line in FIG. 2). The inner wall surface of the casing structure 20 is defined by several primary sections and at least one secondary section. The words "primary section" and "secondary section" are used herein only to distinguish between adjacent portions of the same inner wall surface which have a slightly different structure; these words are not intended to have any other meaning. For example, as shown in FIG. 2, each primary section consists of a short side 25, and a long side 26, with the short side being joined to the long side of an adjacent primary section. In the practice of this invention, the long side 26 of each primary section slopes away from the longitudinal axis 23 of the casing structure, so that it defines an outward slope angle. Adjacent to the primary section is the secondary section, which consists of two long sides, **26*a* and 26*b*. As the drawing indicates, the long side 26*a* slopes away from the longitudinal axis 23 of the casing structure, and the other long side 26*b* slopes toward the longitudinal axis. Side 26*a* thus defines an outward slope angle and side 26*b*** defines an inward slope angle. The purpose in designing the inner wall surface with the slope angles described above is explained in more detail later in this specification.

The float collar of this invention, as illustrated in FIG. 2, has a concrete core 27 positioned inside the casing structure 20. The core 27 is of a similar material to the core 13 in the conventional float collar shown in FIG. 1. The outer surface (or perimeter) of core 27 is in continuous contact with the inner wall surface 24, such that the wall surface provides an anchoring means for retaining the core inside the casing structure. Extending lengthwise through the core 27 is a bore 28, which provides a passage for fluids or slurry compositions to pass through the float collar. The float collar also includes a check valve, which is positioned in the bore 28 of core section 27. The purpose of the check valve is to control the flow of fluids or slurry compositions through the casing structure. The check valve illustrated herein consists of a ball 29 and a ball cage, which includes a cage base 30 and a cage top 31. In practice, other types of check valves which may be used are flapper valves.

OPERATION

Figure 3:
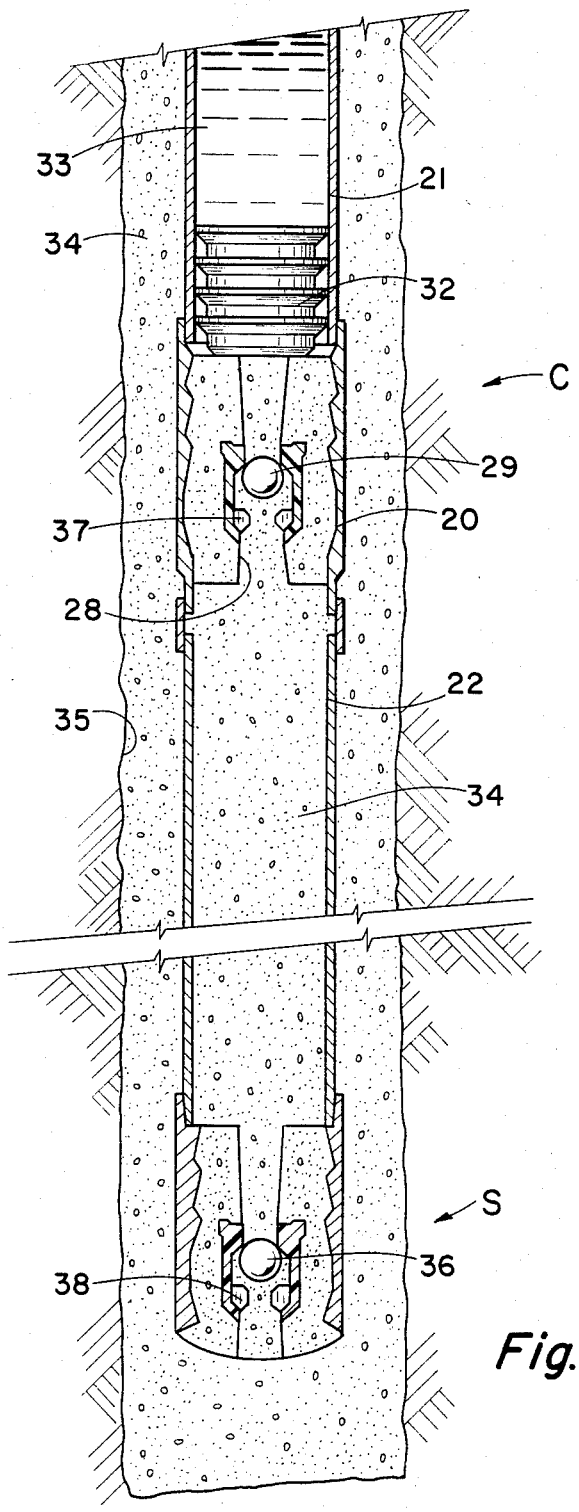
FIG. 3 is a schematic illustration of a wellbore cementing operation, in which a float collar and a float shoe, designed according to the present invention, are used.

The invention will now be illustrated by describing a typical well cementing operation in which the float collar illustrated in FIG. 2 is used. Part of the cementing operation is illustrated schematically in FIG. 3. Referring to FIG. 3, a wiper plug 32 follows the cement slurry 34 down the well casing 21, and the plug is followed by a displacement fluid 33. From the well casing, the cement slurry passes through the float collar C and the float shoe S and into the borehole annulus 35. As the cement slurry is passing through the check valve in collar C, and through shoe S, the valves are in the open position. In the open position, the ball 29 in the collar, and the ball 36 in the shoe, are supported on a set of finger members 37 and 38, at the bottom of the ball cage. This position of the check valves is not illustrated in the drawings.

As described earlier, once the cement has been displaced into the borehole annulus 35, the balls 29 and 36 move to a closed position, that is, they move upwardly and seat into the top part of the ball cage. In FIG. 2, the ball 29 is in its closed position, and in FIG. 3, the ball 29 and ball 36 are both in the closed position. With the valves in the closed position, the heavier cement is prevented from backflowing through the valves and displacing the lighter displacement fluid.

Figure 1:
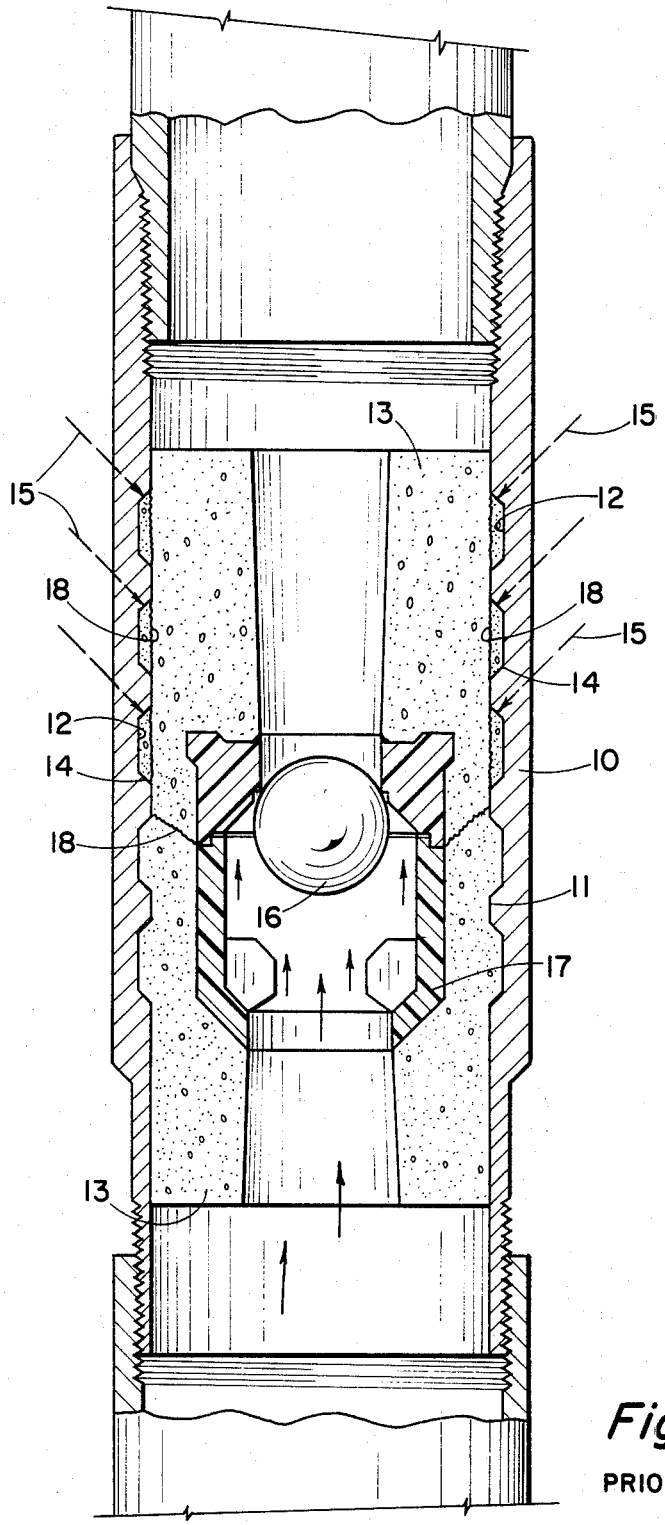
Fig. 1 PRIOR ART
FIG. 1 is a front elevation view, mostly in section, of a conventional float collar having a concrete core therein, and a check valve held in place by the concrete core. The casing structure of this collar is designed such that it places the core section under a predominantly shearing force.

Referring now to FIG. 2, the purpose of constructing the inner wall surface of the casing structure 20 with inward and outward slope angles is to place the concrete core 27 under a radial compressive force, rather than the shearing force which the core 13 is under in the casing structure 10, as shown in FIG. 1. To explain further, the casing structure 20 exerts a force against the core 27 in a direction which is normal (perpendicular)

to the long sides 26 of each primary section, as indicated by the broken arrows 39 in FIG. 2. Because the direction of force, as illustrated by the arrows 39, is mostly inward, rather than downward (as illustrated in FIG. 1), it is primarily a compressive force, with only a small amount of shearing force. Since, the collapse resistance (radial compression) of the concrete core is much greater than its shear resistance, the outward slope angle for the long sides 26 of each primary section should be a relatively shallow angle. For this same reason, the outward slope angle for the long side 26*a*, and the inward slope angle for the long side 26*b*, of the secondary section, should be a shallow angle.

In the practice of this invention, tests were conducted using a non-expanding or prestressed cement for the concrete core 27. From these tests, it was determined that the outward slope angle for the long sides 26 and 26*a*, and the inward slope angle for the long side 26*b* should be not less than about 1.5 degrees, and not more than about 16.7 degrees. Preferably, these slopes angles should be somewhere between about 2.5 and 8.0 degrees.

The most common material for the concrete core 27 is a conventional portland cement composition with aggregate, usually referred to as Class A construction cement. The shear strength of the core should be at least 1700 psi and the compressive strength should be at least 3750 psi. A suitable material for the casing structure 20 is an API grade steel having a tensile strength of 40,000 psi or greater. The downhole pressure which the core 27 is subjected to depends primarily on the casing depth, the amount of fill-up allowed, and the height to which the displaced cement is to be raised. Generally, this pressure value is less than 10,000 psi and the maximum is about 15,000 psi. The casing structure 20 will generally perform its intended function, that is, to retain the core 27 and place the core under a radial compression, at temperatures in the range of −50° F. to +800° F. At temperatures above or below this range, the casing structure may yield or burst.

The invention claimed is:

1. A casing structure designed for lowering into a borehole filled with fluids, the casing structure includes:

a longitudinal axis, as defined by an imaginary straight line which extends through the center of the casing structure;

an inner wall surface defined by several primary sections, each primary section has a long side and a short side, the short side of each primary section is joined to the long side of an adjacent primary section, and the long side of each primary section slopes away from the longitudinal axis of the casing structure, to define an outward slope angle;

the inner wall surface is further defined by at least one secondary section, each secondary section has two long sides, one long side of each secondary section slopes away from the longitudinal axis of the casing structure, to define an outward slope angle, and the other long side slopes toward the longitudinal axis of the casing structure, to define an inward slope angle;

a core member defined by a solid material, the core member has a lengthwise bore therein which defines a passage for fluids to pass through the casing structure, an upper face of the core member is defined at one end of the bore, and a lower face of the core member is defined at the opposite end of the bore, the outer surface of the core member is in continuous contact with the inner wall surface of the casing structure, to provide means for retaining the core member within the casing structure;

a closure member is positioned in the bore of the core member, and the closure member has open and closed positions for controlling the flow of fluids through the casing structure;

wherein, in operation, the casing structure is lowered into a borehole filled with fluids, the closure member moves to its closed position, the fluids exert a hydraulic force against the upper and lower faces of the core member, and the outward and inward slope angles of the inner wall surface of the casing structure cause the core member to be placed under a radial compressive force.

2. The casing structure of claim 1 in which the long side of each primary section of the inner wall surface defines an outward slope angle of between about 1.5 degrees and about 16.7 degrees.

3. The casing structure of claim 1 in which the long side of each primary section of the inner wall surface defines an outward slope angle of between about 2.5 degrees and about 8.0 degrees.

4. The casing structure of claim 1 in which one long side of each secondary section of the inner wall surface defines an outward slope angle of between about 1.5 degrees and about 16.7 degrees, and the other long side of each secondary section of the inner wall surface defines an inward slope angle of between about 1.5 degrees and about 16.7 degrees.

5. The casing structure of claim 1 in which one long side of each secondary section of the inner wall surface defines an outward slope angle of between about 2.5 degrees and about 8.0 degrees, and the other long side of each secondary section of the inner wall surface defines an inward slope angle of between about 2.5 degrees and about 8.0 degrees.

6. The casing structure of claim 1 in which the casing is fabricated of a metal alloy and the core member is fabricated of a concrete composition.

7. The casing structure of claim 6 in which the core member is fabricated of a synthetic cement composition.

* * * * *